US010634024B2

(12) United States Patent
Bogard et al.

(10) Patent No.: US 10,634,024 B2
(45) Date of Patent: Apr. 28, 2020

(54) EXHAUST TUBE AND TUNING TUBE ASSEMBLY WITH WHISTLE REDUCTION FEATURE

(71) Applicant: Faurecia Emissions Control Technologies, USA, LLC, Columbus, IN (US)

(72) Inventors: Joseph Trent Bogard, Seymour, IN (US); Jonathan Wesley Christian, Commerce Township, MI (US); Ankur Anil Joshi, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 260 days.

(21) Appl. No.: 15/506,294

(22) PCT Filed: Sep. 10, 2015

(86) PCT No.: PCT/US2015/049282
§ 371 (c)(1),
(2) Date: Feb. 24, 2017

(87) PCT Pub. No.: WO2016/040543
PCT Pub. Date: Mar. 17, 2016

(65) Prior Publication Data

US 2017/0241311 A1 Aug. 24, 2017

Related U.S. Application Data

(60) Provisional application No. 62/049,040, filed on Sep. 11, 2014.

(51) Int. Cl.
*F01N 1/02* (2006.01)
*F01N 1/08* (2006.01)

(52) U.S. Cl.
CPC ..... *F01N 1/023* (2013.01); *F01N 1/082* (2013.01); *F01N 2310/14* (2013.01)

(58) Field of Classification Search
CPC ..... F01N 1/023; F01N 2310/14
(Continued)

(56) References Cited

U.S. PATENT DOCUMENTS 5,493,080 A * 2/1996 Moss ..... F01N 1/003 181/227
5,726,397 A 3/1998 Mukai et al.
(Continued)

FOREIGN PATENT DOCUMENTS

JP 2011099477 A 5/2011
KR 1019980046351 A 9/1998
KR 2020120003603 U 5/2012

OTHER PUBLICATIONS

International Preliminary Report on Patentability for International Application No. PCT/US2015/049282 dated Mar. 23, 2017.
(Continued)

*Primary Examiner* — Forrest M Phillips
(74) *Attorney, Agent, or Firm* — Carlson, Gaskey & Olds, P.C.

(57) ABSTRACT

A vehicle exhaust system component includes an exhaust tube defining an exhaust gas flow path, a side branch tuning tube connected to the exhaust tube at an interface, and a porous structure associated with the exhaust tube to reduce noise generated at the interface. In one example, the porous structure comprises a perforated orifice in the exhaust tube. In another example, the porous structure comprises a mesh screen or mesh sleeve.

26 Claims, 3 Drawing Sheets

(58) Field of Classification Search
USPC ..... 181/227, 228
See application file for complete search history.

(56) References Cited

U.S. PATENT DOCUMENTS

| | | | | |
|---|---|---|---|---|
| 8,800,713 | B2 | 8/2014 | Keesser et al. | |
| 8,806,859 | B2 * | 8/2014 | Komitsu | F01N 1/02 181/227 |
| 8,955,641 | B2 | 2/2015 | Abram et al. | |
| 2001/0018995 | A1 * | 9/2001 | Uegane | B60K 13/04 181/275 |
| 2001/0045322 | A1 * | 11/2001 | Nilsson | F01N 1/084 181/227 |
| 2010/0270103 | A1 * | 10/2010 | Huff | F01N 1/02 181/266 |
| 2012/0292128 | A1 * | 11/2012 | Keesser | F01N 1/023 181/227 |
| 2013/0126266 | A1 * | 5/2013 | Luttig | F01N 1/08 181/227 |
| 2015/0192055 | A1 * | 7/2015 | Kondo | F01N 1/084 181/227 |
| 2015/0330283 | A1 * | 11/2015 | Carr | F01N 1/086 181/227 |
| 2015/0337699 | A1 * | 11/2015 | Kainuma | F01N 1/023 181/227 |

OTHER PUBLICATIONS

International Search Report from PCT/US2015/049282.

* cited by examiner

EXHAUST TUBE AND TUNING TUBE ASSEMBLY WITH WHISTLE REDUCTION FEATURE

RELATED APPLICATION

This application claims priority to U.S. Provisional Application No. 62/049,040, filed Sep. 11, 2014.

BACKGROUND OF THE INVENTION

The present invention generally relates to tuning tube and exhaust tube assembly.

Vehicle exhaust systems include silencers to reduce noise that is generated by a vehicle's powertrain. In one example configuration, a silencer includes an outer housing having an exhaust inlet and an exhaust outlet. An exhaust gas flow pipe extends through the outer housing from the inlet to the outlet. A side branch tuning tube, such as a Helmholtz tube for example, is connected to the exhaust gas flow pipe within the outer housing to further facilitate reducing noise.

One disadvantage with this configuration is that a whistling noise can be generated at the connection interface between the exhaust gas flow pipe and the side branch tuning tube. Further improvements are needed to reduce or eliminate this whistling noise.

SUMMARY OF THE INVENTION

According to one exemplary embodiment, a vehicle exhaust system component includes an exhaust tube defining an exhaust gas flow path, a side branch tuning tube connected to the exhaust tube at an interface, and a porous structure associated with the exhaust tube to reduce noise generated at the interface.

In a further embodiment of the above, the porous structure comprises a portion of the exhaust tube, and wherein the side branch tuning tube has an inlet end that is fixed to the portion of the exhaust tube.

In a further embodiment of any of the above, the exhaust tube includes a perforated orifice that comprises the porous structure, and wherein the side branch tuning tube has an open inlet end that at least partially overlaps the perforated orifice.

In a further embodiment of any of the above, the porous structure comprises a portion of the exhaust tube that is formed from microperforated material and wherein the side branch tuning tube has an inlet end that is fixed to the portion of the exhaust tube that is formed from microperforated material.

In a further embodiment of any of the above, the side branch tuning tube has an inlet end and an outlet end, and wherein the exhaust tube includes an opening at the interface that is associated with the inlet end of the side branch tuning tube, and wherein the porous structure comprises a sleeve that covers the opening.

In a further embodiment of any of the above, the porous structure comprises a microperforated structure, perforated structure, wire mesh structure, or woven metal structure.

In a further embodiment of any of the above, the porous structure has a predefined overall area and wherein approximately at least 40% of the predefined overall area is an open area.

In a further embodiment of any of the above, an outer housing that surrounds the exhaust tube and side branch tuning tube.

In another exemplary embodiment, a vehicle exhaust system component includes an outer housing defining an open internal cavity, wherein the outer housing includes at least one exhaust gas inlet and at least one exhaust gas outlet, and an exhaust tube positioned within the open internal cavity to define an exhaust gas flow path through the outer housing. The exhaust tube includes an inlet end coupled to the exhaust gas inlet and an outlet end coupled to the exhaust gas outlet, and wherein the exhaust tube includes a perforated orifice at a location between the inlet and outlet ends. A tuning tube is fixed to the exhaust tube, wherein the tuning tube includes a tuning tube inlet that overlaps the perforated orifice and a tuning tube outlet that is open to the internal cavity.

In a further embodiment of any of the above, the tuning tube outlet is non-concentric with the exhaust tube.

In a further embodiment of any of the above, the perforated orifice comprises a plurality of discrete holes extending through a wall thickness of the exhaust tube, and wherein the plurality of discrete holes are only located at an interface between the exhaust tube and the turning tube.

These and other features of the present invention can be best understood from the following specification and drawings, the following of which is a brief description.

DETAILED DESCRIPTION

Figure 1:
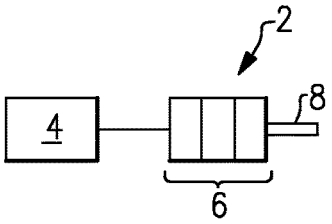
FIG. 1 shows a schematic representation of a vehicle exhaust system.
Figure 2A:
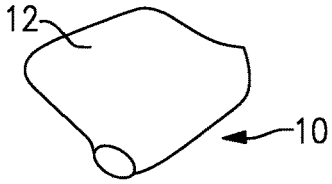
FIG. 2A is a perspective view of one example embodiment of a silencer.
Figure 2B:
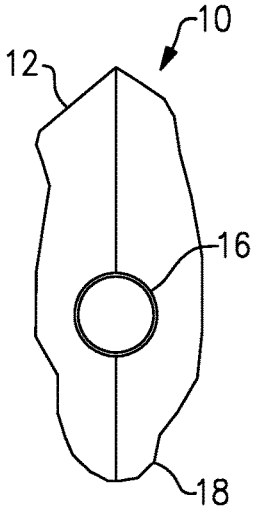
FIG. 2B is an end view of the silencer of FIG. 2A.
Figure 3:
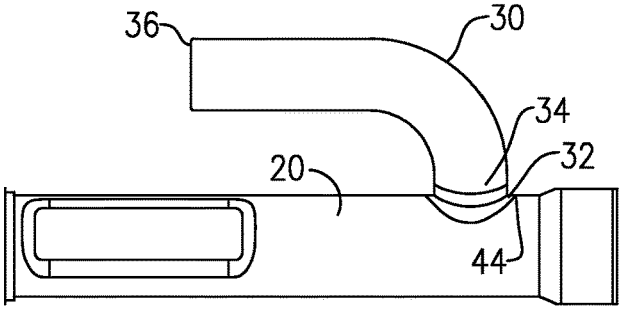
FIG. 3 is a side view of an exhaust tube and tuning tube assembly as enclosed within the silencer of FIGS. 2A-2B.

A vehicle exhaust system 2 conducts hot exhaust gases generated by an internal combustion engine 4 through various downstream exhaust components 6 to reduce emissions and control noise as known. The exhaust components can include diesel oxidation catalysts (DOC), selective catalytic reduction (SCR) catalysts, particulate filters, mufflers, resonators, exhaust pipes, etc. These components can be mounted in various different configurations and combinations dependent upon vehicle application and available packaging space. Exhaust gases pass through the components and are subsequently directed to the external atmosphere via a tailpipe 8, for example.

FIGS. 2A-2B and 3-5 show one example of a vehicle muffler or silencer 10 for a vehicle exhaust system that includes an outer housing 12 that defines an open internal volume 14. The outer housing 12 includes at least one exhaust gas inlet 16 and at least one exhaust gas outlet 18. An exhaust tube 20 defines an exhaust gas flow path F through the silencer 10 from the exhaust gas inlet 16 to the exhaust gas outlet 18. The exhaust tube 20 has an inlet end 22 associated with the exhaust gas inlet 16 and an outlet end 24 associated with the exhaust gas outlet 18. In one example, the inlet end 22 is coupled to the exhaust gas inlet 16 and an outlet end 24 is coupled to the exhaust gas outlet 18 such that the exhaust tube 20 forms the sole exhaust gas flow path through the silencer 10.

A side branch tuning tube 30 is attached to the exhaust tube 20 at a location between the inlet 22 and outlet 24 ends. The side branch tuning tube 30 is connected to the exhaust tube 20 at an interface 32. In one example, the side branch tuning tube 30 comprises a Helmholtz tube. The side branch tuning tube 30 has an inlet end 34 and an outlet end 36 that is non-concentric with the exhaust tube 20. The inlet end 34 is fixed to the exhaust tube 20 and the outlet end 36 is unsupported and spaced apart from the exhaust tube 20. Thus, the exhaust tube 20 carries the exhaust flow through the silencer 10 and the side branch tuning tube 30 is a non-flow pipe that opens into the empty internal volume 14 at the outlet end 36 to facilitate noise reduction.

A porous structure 40 is associated with the exhaust tube 20 to reduce noise generated at the interface 32. The porous structure 40 can be comprised of various different features or configurations and can be formed from different types of material. For example, the porous structure can comprise microperforated material, standard perforated material, wire mesh material, or woven metal material. Other porous materials that could be utilized include eglass, steel wool, and basalt for example. The porous structure can be formed as part of the exhaust tube 20 itself, or can be formed as a separate structure that is attached to the exhaust tube 20.

In one example, the porous structure 40 has a predefined overall area wherein approximately at least 40% of the predefined overall area is an open area. Test results have shown that 40% open area is a minimum area in which the low frequency Helmholtz tuning will not degrade significantly (less than 2 dB). In one example, the porous structure that defines the 40% open area includes openings that are at least 5 mm in size, for example.

Figure 4:
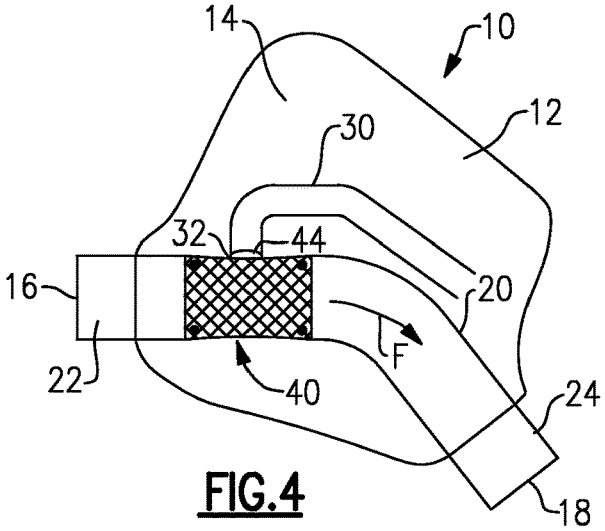
FIG. 4 is a top view of a silencer, exhaust tube and tuning tube assembly incorporating one example embodiment of the subject invention.
Figure 5:
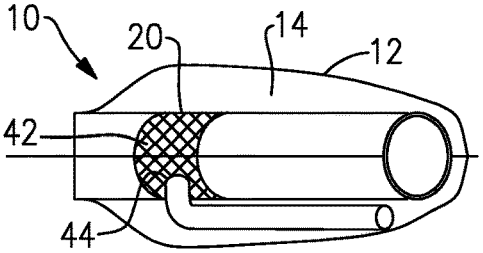
FIG. 5 is a side view showing the exhaust tube and tuning tube positioned within the silencer.
Figure 6A:
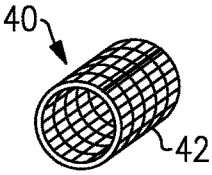
FIG. 6A is a perspective view of one example of a mesh sleeve.
Figure 6B:
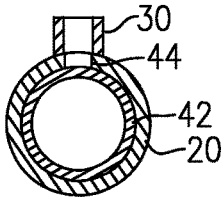
FIG. 6B is an end view of the mesh sleeve positioned within the exhaust tube.

In the example shown in FIGS. 4-6, the porous structure 40 comprises a sleeve 42 that is made from a wire mesh or woven metal material, for example. In the example, the exhaust tube 20 includes an opening 44 that is associated with the inlet end 34 of the side branch tuning tube 30. The opening 44 that is associated with the inlet end 34 of the side branch tuning tube 30 is determined by the size of the tube 30.

The sleeve 42 is positioned to cover the opening 44. The sleeve 42 can be positioned internally (FIG. 6B) within the exhaust tube 20 to cover the opening 44, or the sleeve 42 could surround an outer surface of the exhaust tube 20 (FIGS. 4-5) to cover the opening 44. The sleeve 42 can be fixed in place by any of various attachment methods such as welding or brazing, for example.

The side branch tuning tube 30 is attached to the exhaust tube 20 at the interface 32, which is at the opening 44. The side branch tuning tube 30 can be attached using any of various attachment methods including welding or brazing for example.

Figure 10:
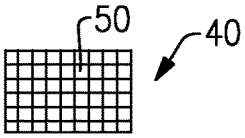
FIG. 10 is a top view of a mesh patch.
Figure 9:
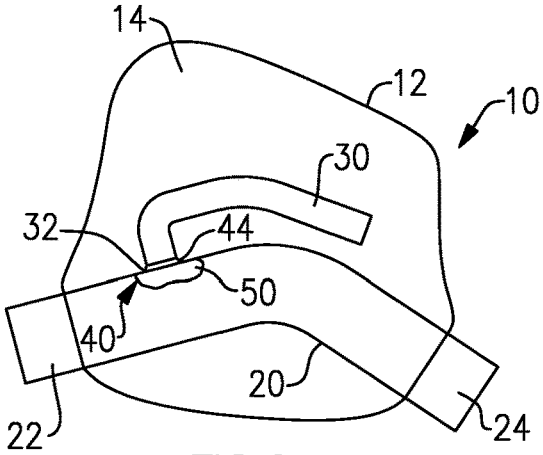
FIG. 9 is a top view of another example of a silencer, exhaust tube and tuning tube assembly incorporating one example embodiment of the subject invention.
Figure 11:
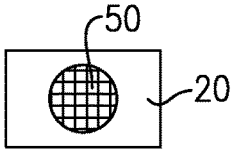
FIG. 11 is a schematic view of an internally mounted mesh patch.
Figure 12:
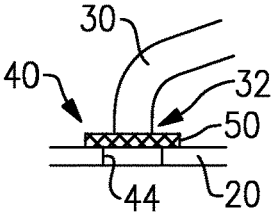
FIG. 12 is a schematic view of an externally mounted mesh patch.

In another example, the porous structure 40 comprises a patch 50 (FIGS. 9-12) that covers the opening 44. The patch 50 can be internally (FIG. 9) or externally (FIG. 12) mounted to cover the opening 44. The patch (FIG. 10) can be formed as a wire mesh or steel wool patch, for example.

Figure 7:
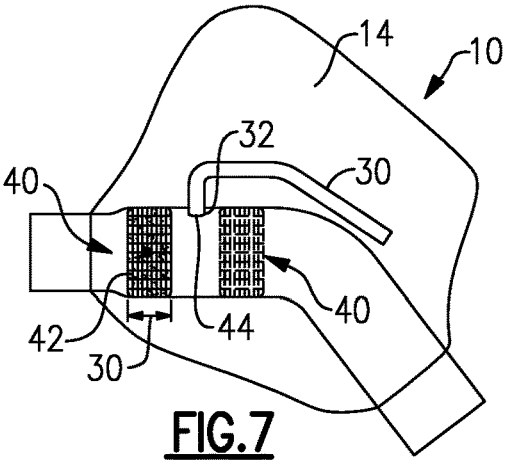
FIG. 7 is a top view of another example of a silencer, exhaust tube and tuning tube assembly incorporating one example embodiment of the subject invention.
Figure 8:
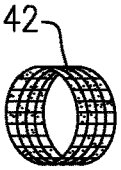
FIG. 8 is a perspective view of a wire mesh screen.

In another example, the porous structure 40 is positioned within the exhaust tube 20 immediately upstream or downstream of the opening 44 (FIG. 7). For example, the porous structure 40 could be a sleeve 42 or patch 50 that is mounted internally within the exhaust tube 20 at an upstream or downstream location relative to the opening 44.

In the examples discussed above, the sleeve 42 or patch 50 is comprised of a single layer of porous material. However, the sleeve or patch could also be formed from multiple layers of material such as a steel wool or fiber layer in combination with an expanded metal (microperforated material), wire mesh, or perforated sheet of material.

Figure 13:
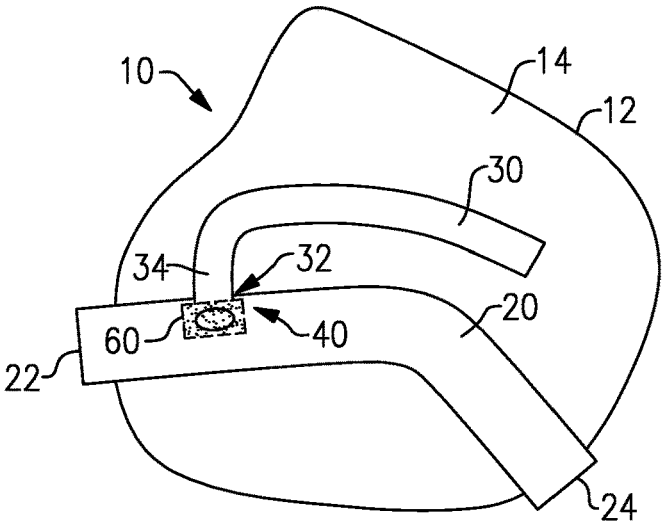
FIG. 13 is a top view of another example of a silencer, exhaust tube and tuning tube assembly incorporating one example embodiment of the subject invention.
Figure 14:
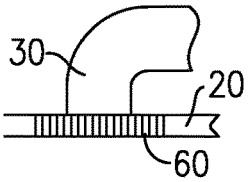
FIG. 14 is a schematic view of an interface between the tuning tube and exhaust tube of FIG. 13.

In another example, the porous structure 40 comprises a portion 60 of the exhaust tube 20 that is formed as microperforated material (FIGS. 13-14). This type of material has a high density of very small openings extending through the tube wall. This material is discussed in greater detail in applicant's application number PCT/US2014/032302 filed on Mar. 31, 2014, and which is herein incorporated by reference.

The inlet end 34 of the side branch tuning tube 30 is fixed to the portion 60 of the exhaust tube 20 that is formed from microperforated material. This configuration has the advantage that a separate piece of material is not required to be attached to the exhaust tube 20. Further, while the portion 60 could be formed as microperforated material, the portion 60 could include standard pipe perforations dependent upon the level of noise control desired.

Figure 15:
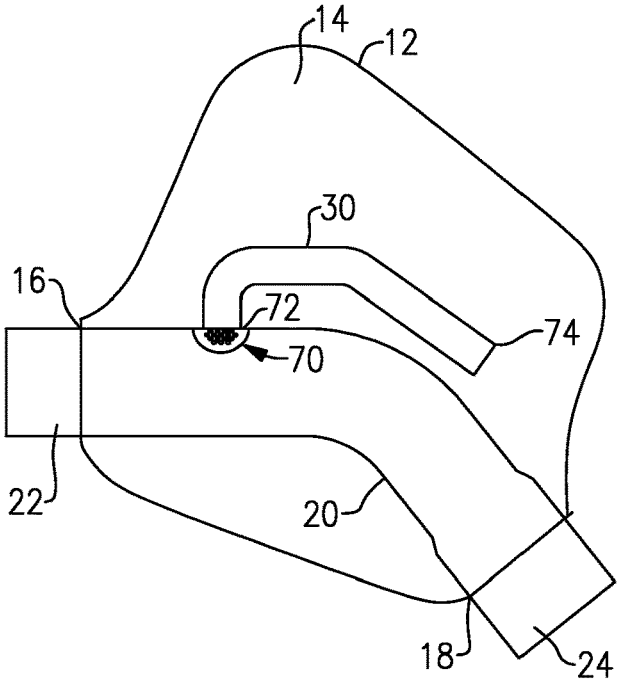
FIG. 15 is a top view of another example of a silencer, exhaust tube and tuning tube assembly incorporating one example embodiment of the subject invention.
Figure 16A:
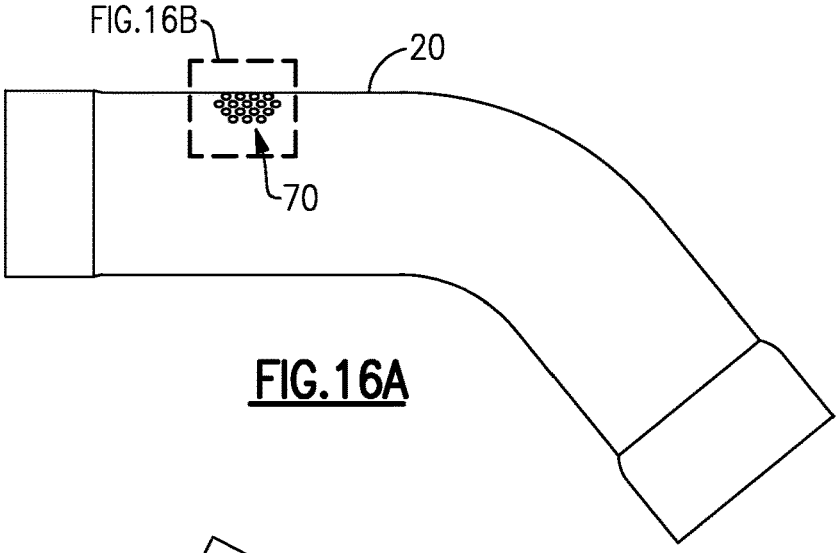
FIG. 16A is a side view of the exhaust tube of FIG. 15.
Figure 16B:
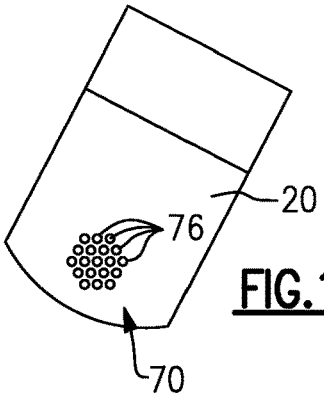
FIG. 16B is an enlarged view of a portion of the exhaust tube as identified in FIG. 16A.

Such an example is shown in FIGS. 15 and 16A-16B. As discussed above, the outer housing 12 defines an open internal cavity 14 and includes at least one exhaust gas inlet 16 and at least one exhaust gas outlet 18. The exhaust tube 20 is positioned within the open internal cavity 14 to define an exhaust gas flow path through the outer housing 12. The inlet end 22 of the exhaust tube 20 is coupled to the exhaust gas inlet 16 and an outlet end 24 is coupled to the exhaust gas outlet 18. In this example, the exhaust tube 20 includes a perforated orifice 70 at a location between the inlet 22 and outlet 24 ends. The tuning tube 30 is fixed to the exhaust tube 20 such that a tuning tube inlet 72 overlaps the perforated orifice 70 and a tuning tube outlet 74 is open to the internal cavity 14.

In one example, the perforated orifice 70 comprises a plurality of discrete holes 76 extending through a wall thickness of the exhaust tube 20. The plurality of discrete holes 76 are only located at an interface between the exhaust tube 20 and the turning tube 30.

The subject invention uses a porous structure or feature at a large orifice interface wherein the porous structure is comprised of a plurality of openings each having at least a 5 mm diameter at the overlap between an exhaust pipe and a tuning pipe. By using a perforated orifice, or by using a porous structure upstream or downstream of the interface 32 or opening, or by using a mesh sleeve or patch to cover the opening, the fluid boundary layer is disturbed such that organized vertical structures cannot form across the interface/opening. As such, standing waves are not produced, which therefore reduces or eliminates whistling noise at this location.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The invention claimed is:

1. A vehicle exhaust system component comprising:

an outer housing that provides an internal volume;

an exhaust tube defining an exhaust gas flow path through the internal volume, wherein the exhaust tube includes at least one opening formed in an outer peripheral surface of the exhaust tube, the opening extending through a wall thickness of the exhaust tube from the outer peripheral surface to an inner peripheral surface;

a side branch tuning tube connected to the exhaust tube at an interface that includes the opening, wherein the outer housing surrounds the exhaust tube and side branch tuning tube, and wherein the side branch tuning tube comprises a non-flow pipe that opens into the internal volume; and a porous structure mounted to the exhaust tube to reduce noise generated at the interface, wherein the porous structure comprises a mesh sleeve or patch that is mounted to at least one of the outer peripheral surface or the inner peripheral surface.

2. The vehicle exhaust system component according to claim 1, wherein the side branch tuning tube has an inlet end and an outlet end, and wherein the opening at the interface is associated with the inlet end of the side branch tuning tube, and wherein the porous structure comprises the mesh sleeve which is positioned to cover the opening.

3. The vehicle exhaust system component according to claim 2, wherein the mesh sleeve is positioned internally within the exhaust tube and is mounted to the inner peripheral surface to cover the opening.

4. The vehicle exhaust system component according to claim 2, wherein the mesh sleeve surrounds the outer peripheral surface of the exhaust tube to cover the opening.

5. The vehicle exhaust system component according to claim 1, wherein the side branch tuning tube has an inlet end and an outlet end, and wherein the opening at the interface is associated with the inlet end of the side branch tuning tube, and wherein the porous structure comprises the mesh patch which is positioned to cover the opening.

6. The vehicle exhaust system component according to claim 5, wherein the mesh patch is internally or externally mounted to cover the opening.

7. The vehicle exhaust system component according to claim 1, wherein the side branch tuning tube has an inlet end and an outlet end, and wherein the opening at the interface is associated with the inlet end of the side branch tuning tube, and wherein the porous structure is mounted to the inner peripheral surface and is positioned within the exhaust tube immediately upstream or downstream of the opening.

8. The vehicle exhaust system component according to claim 1, wherein the porous structure comprises a microperforated structure, perforated structure, wire mesh structure, or woven metal structure.

9. The vehicle exhaust system component according to claim 1, wherein the porous structure has a predefined overall area and wherein approximately at least 40% of the predefined overall area is an open area.

10. The vehicle exhaust system component according to claim 1, wherein the outer housing has at least one exhaust gas inlet and at least one exhaust gas outlet, and wherein the exhaust tube has an inlet end associated with the exhaust gas inlet and an outlet end associated with the exhaust gas outlet, and wherein the side branch tuning tube is attached to the exhaust tube at a location between the inlet and outlet ends.

11. The vehicle exhaust system component according to claim 10, wherein the vehicle exhaust system component comprises a silencer that provides the outer housing, and wherein the side branch tuning tube comprises a Helmholtz tube that is open to an empty volume within the silencer while the exhaust tube directs engine exhaust gases through the silencer from the exhaust gas inlet to the exhaust gas outlet.

12. The vehicle exhaust system component according to claim 10, wherein the exhaust tube forms the sole exhaust gas flow path through the outer housing such that exhaust gas flows directly from the inlet end to the outlet end without exiting the exhaust pipe.

13. The vehicle exhaust system component according to claim 12, wherein the side branch tuning tube comprises the only component attached to the exhaust pipe within the outer housing, and wherein overlap between a side branch tuning tube inlet and the interface disturbs a fluid boundary layer such that organized vertical structures cannot form across the interface.

14. The vehicle exhaust system component according to claim 1, wherein the porous structure disturbs a fluid boundary layer along an inner surface of the exhaust tube such that organized vertical structures cannot form across the interface.

15. A vehicle exhaust system component comprising:

an outer housing defining an open internal cavity, wherein the outer housing includes at least one exhaust gas inlet and at least one exhaust gas outlet;

an exhaust tube positioned within the open internal cavity to define an exhaust gas flow path through the outer housing, and wherein the exhaust tube includes an inlet end coupled to the exhaust gas inlet and an outlet end coupled to the exhaust gas outlet, and wherein the exhaust tube includes an outer peripheral surface and an inner peripheral surface, and wherein the exhaust tube includes at least one of a perforated orifice formed directly in the exhaust tube at a location between the inlet and outlet ends and an opening extending through a wall thickness of the exhaust tube from the outer peripheral surface to the inner peripheral surface at a location between the inlet and outlet ends; and a tuning tube fixed to the exhaust tube, wherein the tuning tube includes a tuning tube inlet and a tuning tube outlet that is open to the internal cavity, and wherein the tuning tube comprises a non-flow pipe that opens into the open internal cavity, and wherein the tuning tube inlet overlaps the perforated orifice, or the tuning tube inlet overlaps the opening, and including a mesh sleeve or patch that is mounted to at least one of the outer peripheral surface or the inner peripheral surface when the tuning tube inlet overlaps the opening.

16. The vehicle exhaust system component according to claim 15, wherein the tuning tube outlet is non-concentric with the exhaust tube.

17. The vehicle exhaust system components according to claim 15, wherein the perforated orifice comprises a plurality of discrete holes extending through the wall thickness of the exhaust tube, and wherein the plurality of discrete holes are only located at an interface between the exhaust tube and the turning tube.

18. The vehicle exhaust system component according to claim 15, wherein the perforated orifice has a predefined overall area and wherein approximately at least 40% of the predefined overall area is an open area.

19. The vehicle exhaust system component according to claim 15, wherein the exhaust tube forms the sole exhaust gas flow path through the outer housing such that exhaust gas flows directly from the inlet end to the outlet end without exiting the exhaust pipe.

20. The vehicle exhaust system component according to claim 19, wherein the tuning tube comprises the only component attached to the exhaust pipe within the outer housing, and wherein overlap between the tuning tube inlet and the perforated orifice disturbs a fluid boundary layer such that organized vertical structures cannot form across the perforated orifice.

21. The vehicle exhaust system component according to claim 15, wherein the perforated orifice disturbs a fluid boundary layer along an inner surface of the exhaust tube such that organized vertical structures cannot form across the perforated orifice.

22. The vehicle exhaust system component according to claim 15, wherein the mesh sleeve disturbs a fluid boundary layer along the inner peripheral surface of the exhaust tube such that organized vertical structures cannot form across the opening, and wherein the mesh sleeve is mounted to the outer peripheral surface or the inner peripheral surface and covers the opening, or wherein the mesh sleeve is mounted to the inner peripheral surface and is positioned within the exhaust tube immediately upstream or downstream of the opening.

23. The vehicle exhaust system component according to claim 15, wherein the mesh patch disturbs a fluid boundary layer along the inner peripheral surface of the exhaust tube such that organized vertical structures cannot form across the opening, wherein the mesh patch is mounted to the outer peripheral surface or the inner peripheral surface and covers the opening, or wherein the mesh patch is mounted to the inner peripheral surface and is positioned within the exhaust tube immediately upstream or downstream of the opening.

24. A vehicle exhaust system component comprising:

an outer housing that provides an internal volume;

an exhaust tube defining an exhaust gas flow path through the internal volume;

a side branch tuning tube connected to the exhaust tube at an interface, wherein the outer housing surrounds the exhaust tube and side branch tuning tube, and wherein the side branch tuning tube comprises a non-flow pipe that opens into the internal volume; and a porous structure comprising a perforated wall portion formed directly in the exhaust tube at the interface to reduce noise generated at the interface.

25. The vehicle exhaust system component according to claim 24, wherein the perforated wall portion comprises a microperforated portion having a high density of very small openings extending through a wall of the exhaust tube.

26. The vehicle exhaust system component according to claim 24, wherein the exhaust tube includes a plurality of discrete holes extending through a wall thickness of the exhaust tube, and wherein the perforated wall portion comprises the plurality of discrete holes which are only located at the interface between the exhaust tube and the side branch turning tube.

* * * * *